US006739754B2

(12) United States Patent
Moor et al.

(10) Patent No.: US 6,739,754 B2
(45) Date of Patent: May 25, 2004

(54) STORAGE POUCH WITH RETENTION NET

(75) Inventors: Marc L. Moor, Oakwood, OH (US); Jeffrey T. DeBord, Worthington, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 09/730,037

(22) Filed: Dec. 5, 2000

(65) Prior Publication Data

US 2002/0067866 A1 Jun. 6, 2002

(51) Int. Cl.[7] ..... B65D 30/22

(52) U.S. Cl. ..... 383/40; 383/119; 190/102; 224/651; 224/680

(58) Field of Search ..... 190/102, 108; 224/153, 650, 651, 680; D3/216, 217, 269, 303, 900; 383/119, 40

(56) References Cited

U.S. PATENT DOCUMENTS 672,173 A * 4/1901 Fevre ..... 190/102
2,781,113 A * 2/1957 Seeman ..... 190/102
4,029,243 A * 6/1977 Zerobnick et al. ..... 224/664
4,096,978 A * 6/1978 Noice ..... 224/652 X
4,784,248 A * 11/1988 Workman ..... 112/419
4,982,883 A * 1/1991 Ullal et al. ..... 224/651
D382,110 S * 8/1997 Pollari ..... D3/217
5,676,296 A * 10/1997 Masters ..... 224/651 X
D396,952 S * 8/1998 Liu ..... D3/216
5,826,771 A * 10/1998 Peng ..... 224/680 X
5,890,571 A * 4/1999 Sadow ..... 190/102
5,957,355 A * 9/1999 Swetish ..... 224/650
D431,903 S * 10/2000 Worley et al. ..... D3/232
6,135,334 A * 10/2000 Seichter ..... 224/651
6,170,130 B1 * 1/2001 Hamilton et al. ..... 224/257
6,202,910 B1 * 3/2001 Swetish ..... 224/651 X
6,290,114 B1 * 9/2001 Berberian ..... 224/637

* cited by examiner

*Primary Examiner*—Jes F. Pascua
(74) *Attorney, Agent, or Firm*—Thompson Hine LLP

(57) ABSTRACT

A pouch for receiving loose items comprising a body having an outer surface and an inner cavity and a cord located on the outer surface for trapping loose items between the cord and the outer surface. The pouch further includes a stiffening element extending substantially about the perimeter of the body.

21 Claims, 7 Drawing Sheets

STORAGE POUCH WITH RETENTION NET

BACKGROUND OF THE INVENTION

Pouches are used by students and professionals for storing a variety of loose items, such as pens, pencils, calculators, personal organizers, cell phones, keys, notepads, electronic devices and other various school supplies and business supplies. The pouches typically include an inner cavity that can be accessed by a closable opening. However, such a pouch is typically limited in the volume of items it can receive in its inner cavity. Furthermore, the items stored in a conventional pouch may be difficult to access. Accordingly, there is a need for a pouch having an easily accessible auxiliary storage space.

SUMMARY OF THE INVENTION

The present invention is a pouch having an easily accessible auxiliary storage space on its outer surface. The pouch includes a cord, retention net, strap or other surface on its outer surface for receiving loose items between the cord, retention net, strap or surface and the outer surface of the pouch body. The pouch may include a stiffening element extending around its perimeter which enables the pouch to retain its shape when items are received in the auxiliary storage space. In a preferred embodiment, the invention is a pouch for receiving loose items comprising a body having an outer surface and an inner cavity and a cord located on the outer surface for trapping loose items between the cord and the outer surface. The pouch further includes a stiffening element extending substantially about the perimeter of the body.

Other objects and advantages of the present invention will be apparent from the following description and the accompanying drawings.

DETAILED DESCRIPTION

Figure 6:
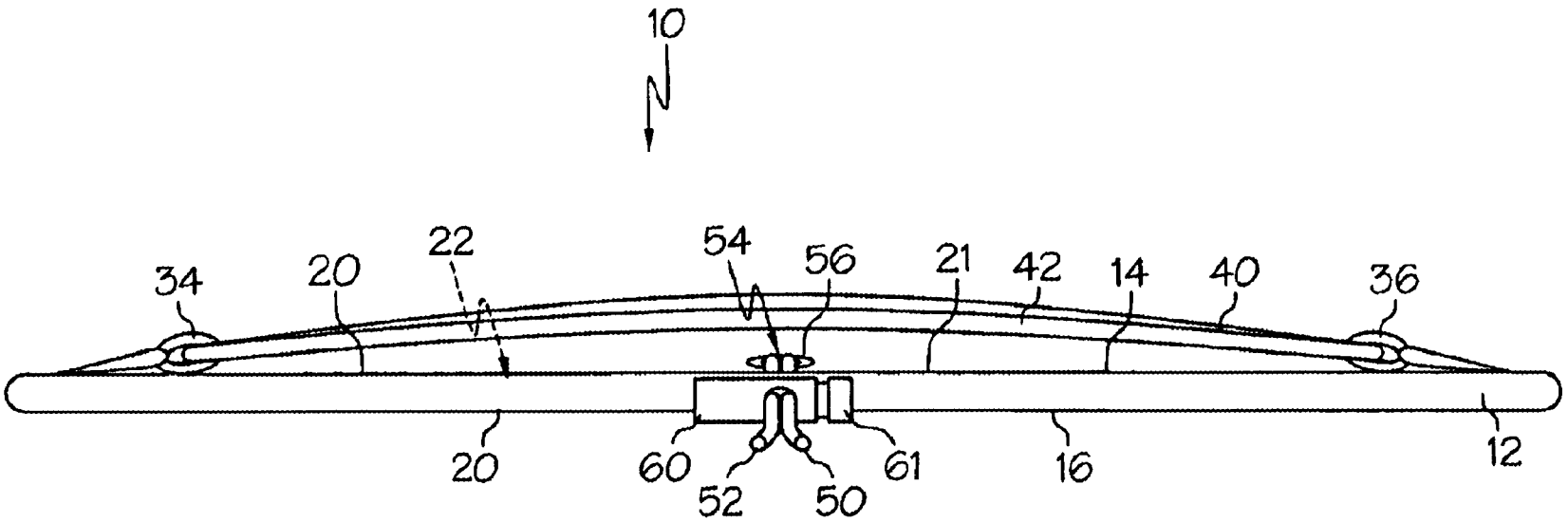
FIG. 6 is a side view of the pouch of FIG. 1.

As shown in FIGS. 1–6, the present invention is a pouch 10 including a pouch body 12 having a rectangular, generally flat upper surface 14 coupled to a rectangular, generally flat lower surface 16 (see FIG. 6). The upper surface 14 and lower surface 16 are joined at their outer perimeters to form the pouch body 16 having an outer surface 20 and an inner cavity 22. In the illustrated embodiment, the upper surface 14 includes a central mesh area 15 surrounded by a top panel 17, bottom panel 19, and side panels 21, 23. Of course, a wide variety of pouches having various shapes may be used without departing from the scope of the present invention.

The upper surface 14 includes a slit 24 to provide selective access to the inner cavity 22, and a closing component, such as a zipper 26, is located on the slit 24. The pouch 10 preferably includes a stiffening element, such as a wire 30 (FIG. 2), extending around the perimeter of the pouch 10 and stitched into the pouch body 16. Various other stiffening elements such as plastic, cardboard, metals or composites formed in a variety of shapes such as flat, cylindrical, coiled, extruded and the like may be located around the perimeter of the pouch 10. The pouch 10 further includes a set of four loops 32, 34, 36, 38 on the upper surface 14, each loop being located adjacent a corner of the upper surface 14.

Figure 1:
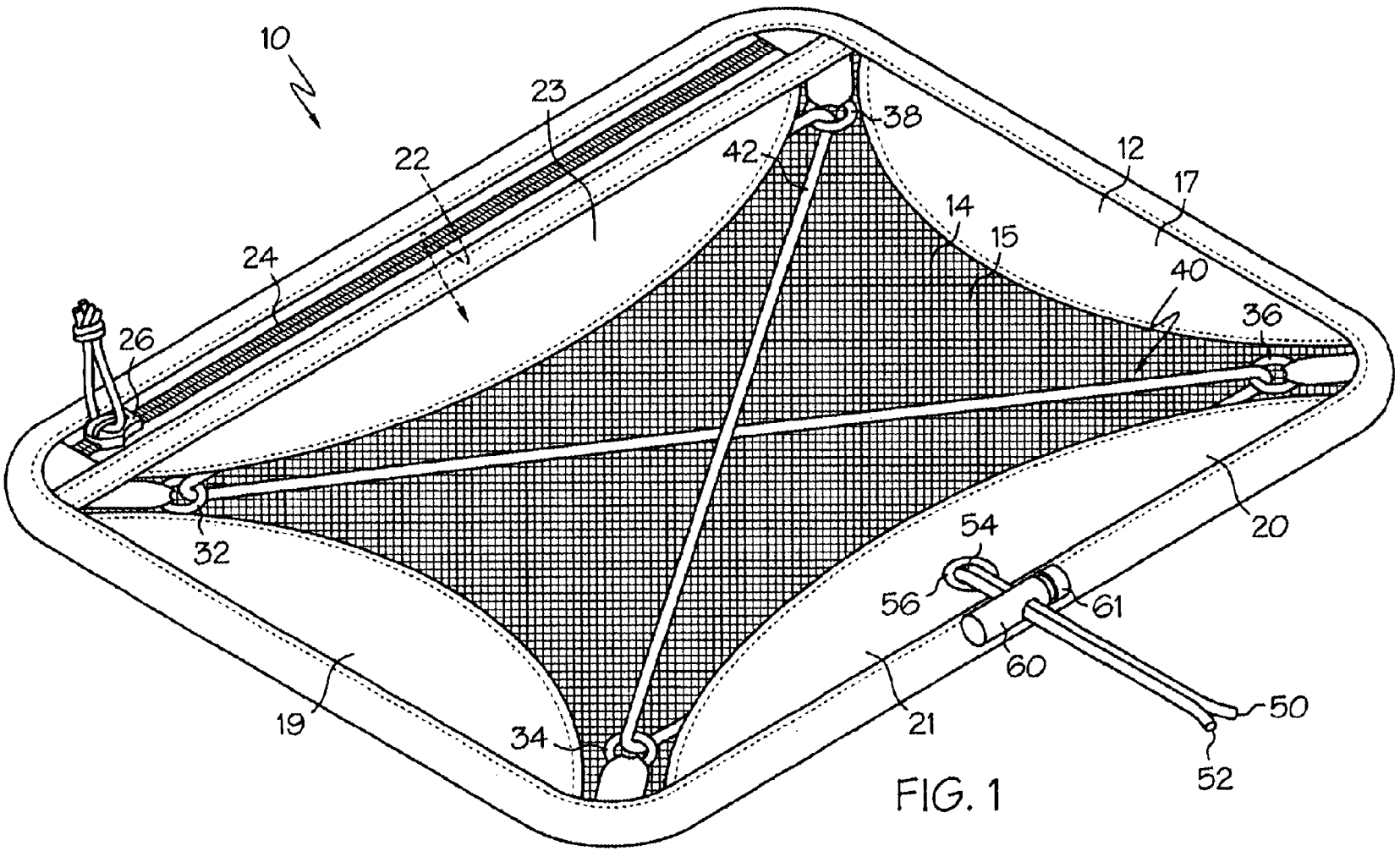
FIG. 1 is a perspective front view of one embodiment of the pouch of the present invention.
Figure 2:
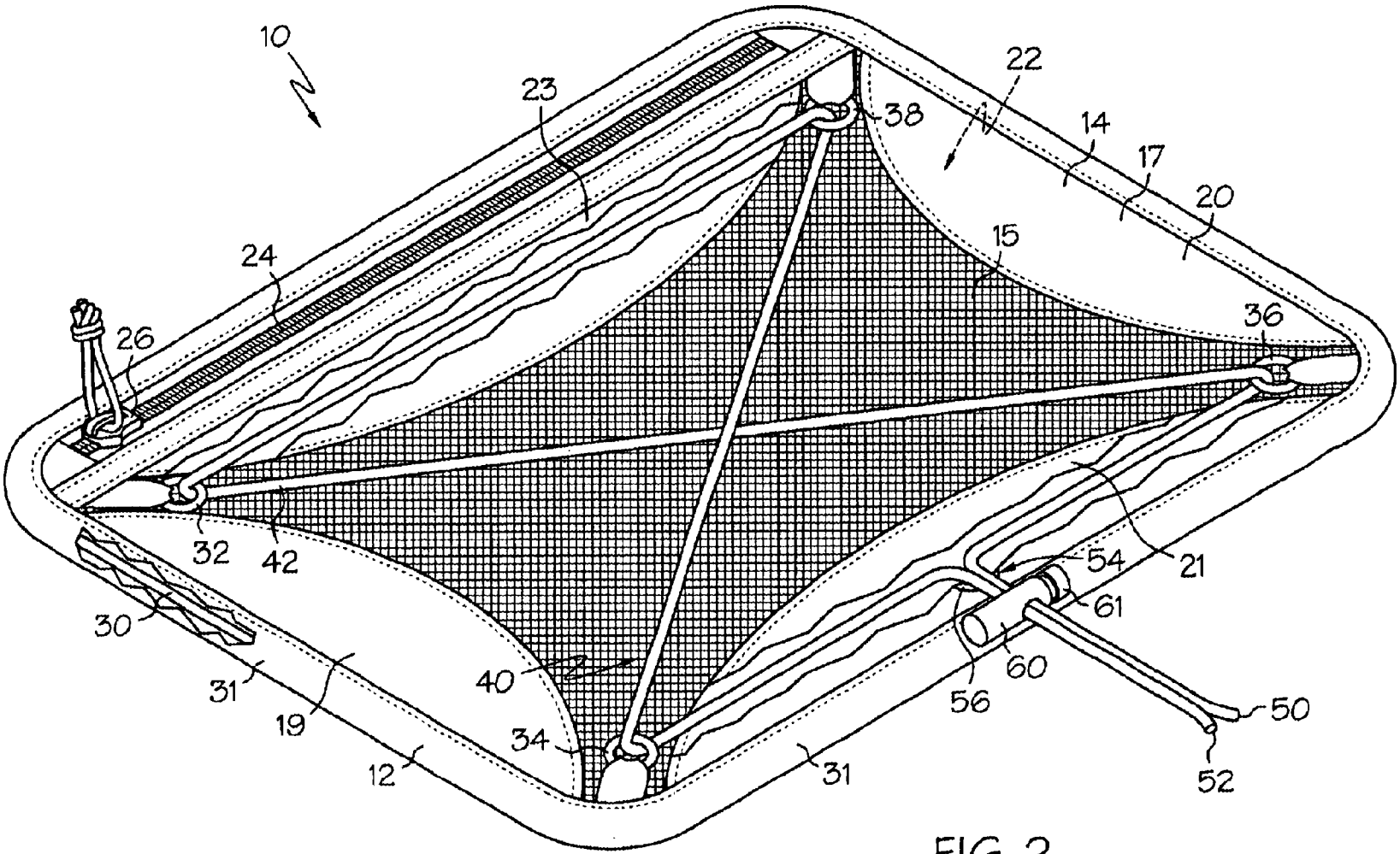
FIG. 2 is a perspective view of the pouch of FIG. 1, with sections of the front cover removed to illustrate the path of the cord and the stiffening element.
Figure 3:
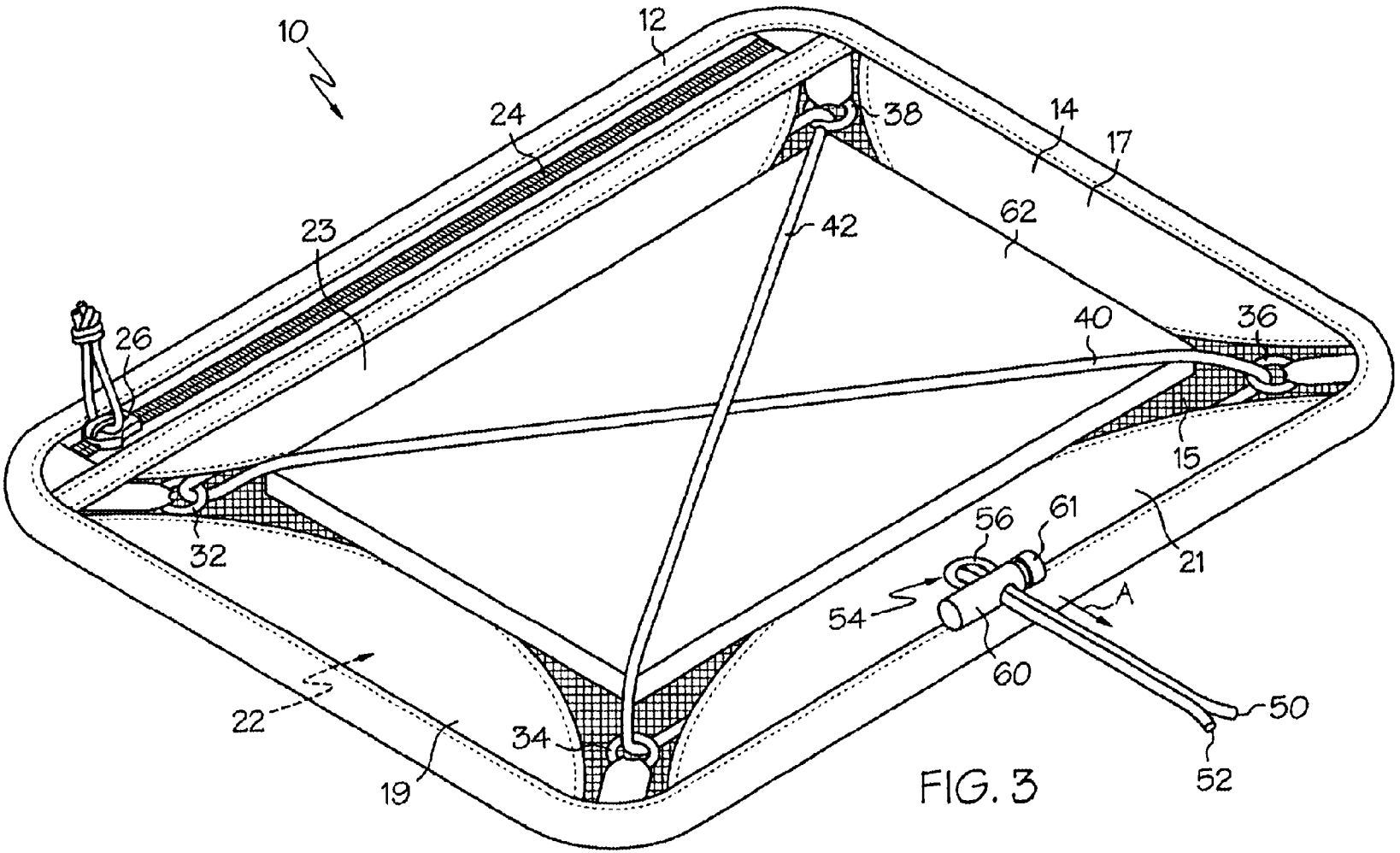
FIG. 3 is a perspective view of the pouch of FIG. 1, illustrating an item received under the cord.

The pouch 10 includes a retention net, generally designated 40, located on the upper surface 14. In the embodiment shown in FIGS. 1–4, the retention net 40 is a cord 42. The cord 42 extends between all four loops 32, 34, 36, 38 in a generally criss-cross manner to form a "X" shaped retention net 40. As shown in FIG. 2, the cord 42 may be routed below the side panels 21, 23.

The cord 42 includes a pair of ends 50, 52. The cord 42 is looped across the upper surface 14 by passing the cord through the access opening 54 defined by grommet 56, down to loop 34, traversing the face of the upper surface 14 to loop 38, down to loop 32, across the upper surface 14 to loop 36, and then down to and out of the access opening 54 formed in side panel 21. A locking component 60, such as a barrel lock, as is well known in the art, slidably yet lockingly receives both ends 50, 52 of the cord therethrough.

The cord 42 forms a retention net 40 such that a loose component 62 (FIG. 3) can be received between the retention net 40 and the upper surface 14 or outer surface 20 of the pouch 10. Thus, the cord 42 provides a auxiliary storage volume that can be used when the inner cavity 22 of the pouch 10 is full, and can be quickly and easily accessed.

Figure 7:
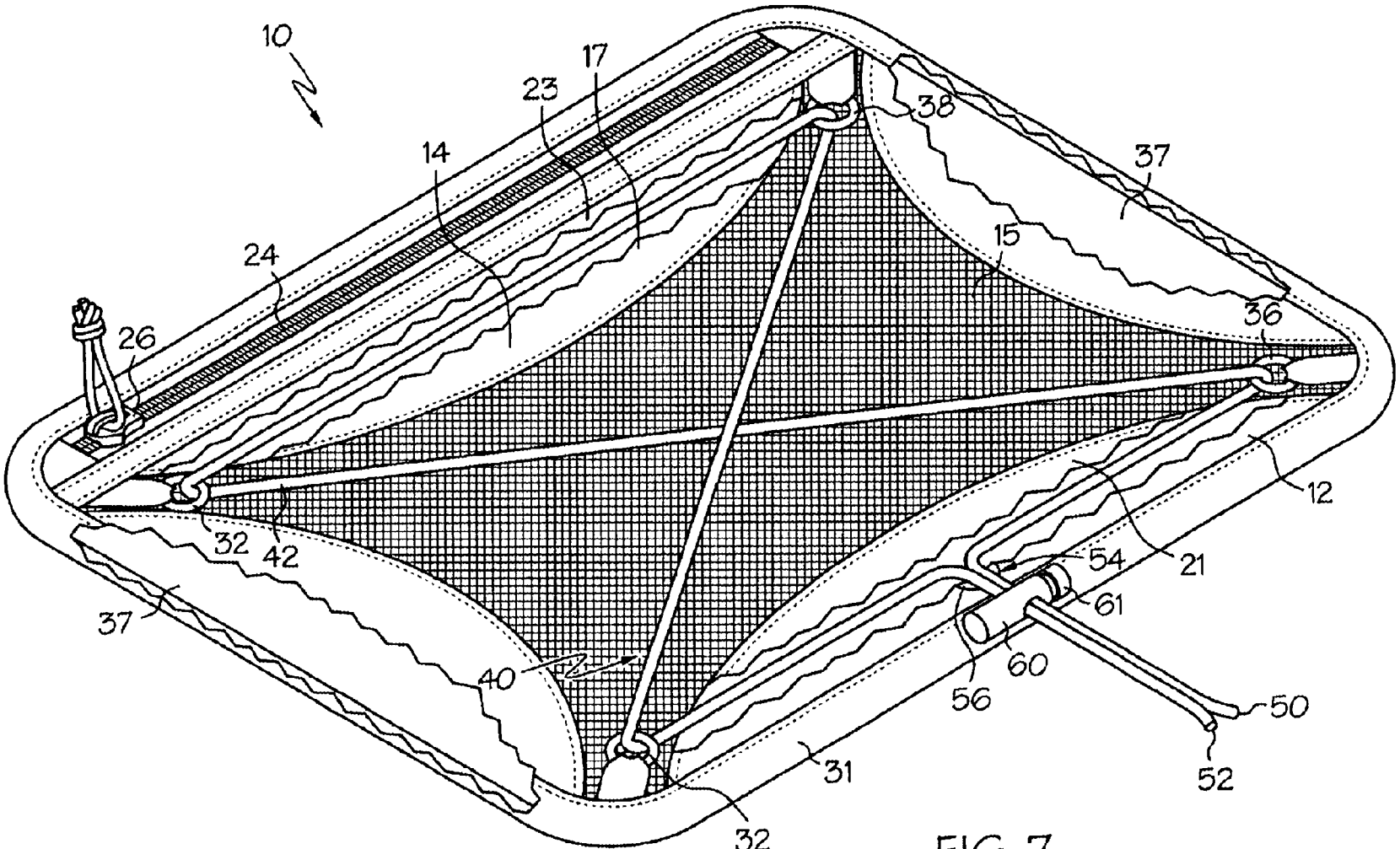
FIG. 7 is a perspective front view of another embodiment of the pouch of the present invention, with section of the front cover removed to illustrate the generally planar stiffening element.

The cord 42 may be formed of an elastic material such that it can be expanded to accommodate differently sized items in the storage space. Furthermore, the stiffening element 30 that extends substantially around the perimeter of the pouch 10 enables the pouch 10 to retain its natural shape when items are located under the retention net 40. For example, when a relatively large item is located below the retention net 40, the pouch 10 has a tendency to "curl up" around the item due to tension in the cord 42. However, the stiffening element 30 ensures that the pouch 10 remains generally flat in its desired rectangular shape. In the illustrated embodiment, the stiffening element is received in outer stitching 31 of the body 16. However, the stiffening element may also take a variety of shapes, such as a generally "X" shaped stiffening element located on the upper 14 or lower 16 surfaces, a generally flat, planar stiffening element 37 (see FIG. 7), and the like.

Of course, the shape and path of the net 40 and cord 42 can take a variety of shapes beyond that disclosed herein, and the criss-cross shape of FIGS. 1–4 is illustrative of only one configuration of the cord 42. For example, the cord 42 may include several loops or portions that extend generally longitudinally across the length of the body 14, or laterally across the width of the body 14, or both longitudinally or laterally, or form various other angles. Furthermore, the retention net 40 need not be a cord, and can assume a variety of shapes and materials. For example, in an alternate embodiment shown in FIG. 5, the retention net 40 may be a piece of netting material 70.

Figure 4:
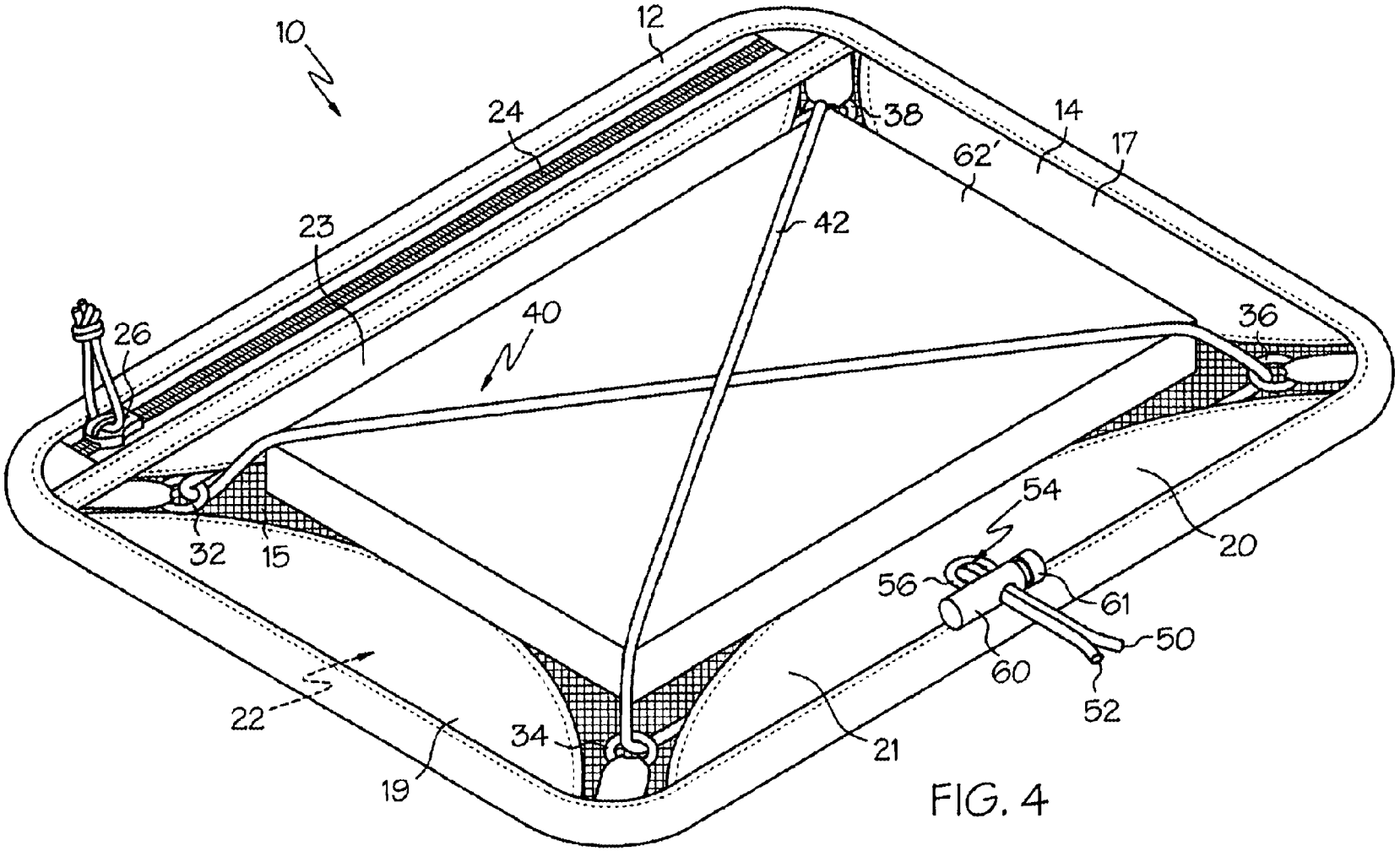
FIG. 4 is a perspective view of the pouch of FIG. 1 with the effective length of the cord increased and a larger item located thereunder.
Figure 5:
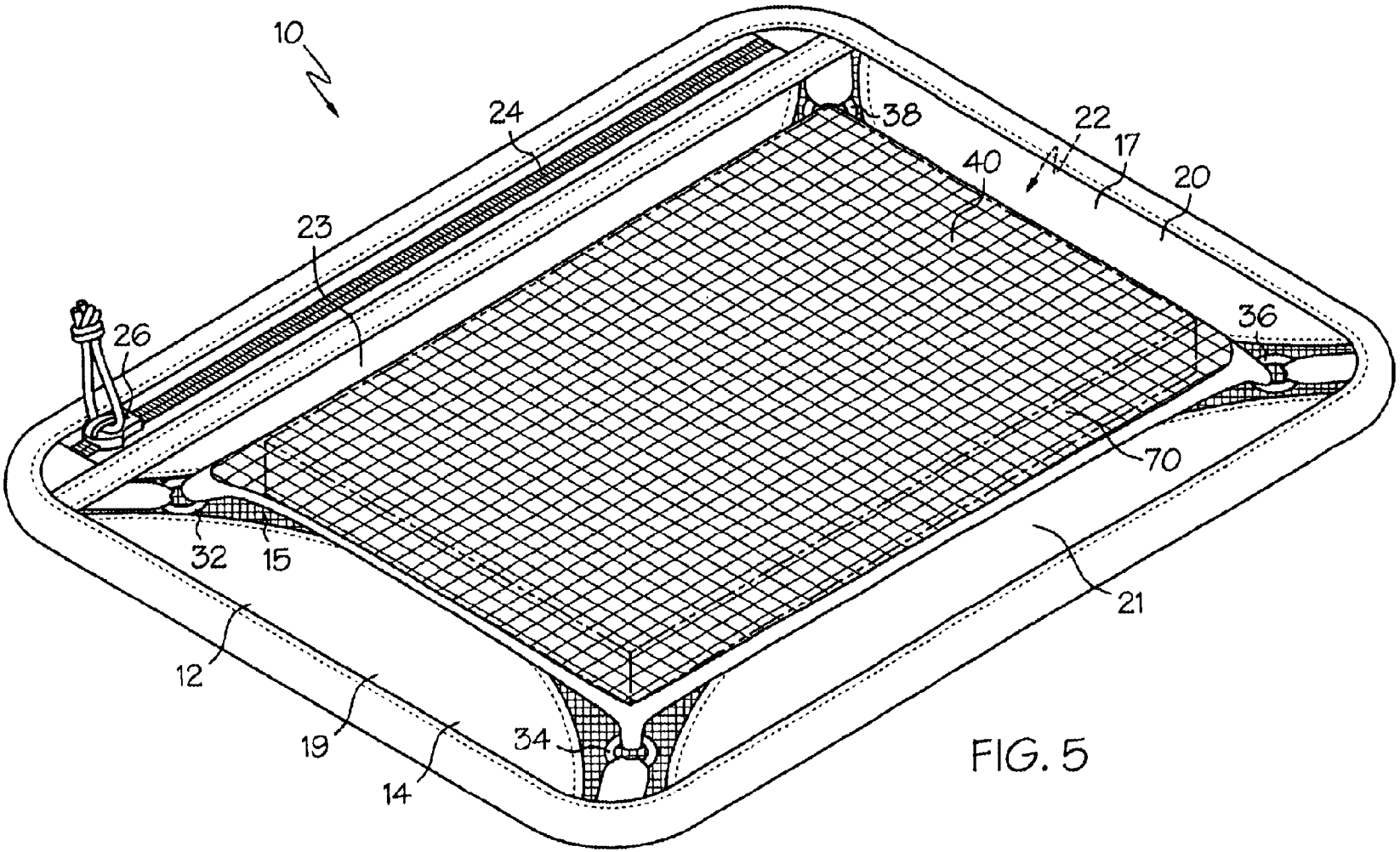
FIG. 5 is a perspective of an alternate embodiment of the present invention.

The effective size or length of the cord 42 can be varied to adjust the size of the auxiliary storage space located between the cord 42 and the outer surface 12 of the pouch 10. In the illustrated embodiment, the effective length of the cord 42 can be adjusted by loosening the locking component 60 (such as by pressing end button 61 so that the barrel lock 60 can slide along the cord 42) and sliding the locking component 60 towards the ends 50, 52 of the cord 42, as shown by arrow A in FIG. 3. Once the locking component 60 is moved to its desired position, it is locked in place, such as by releasing the end button 61 which causes the barrel lock 60 to frictionally engage the cord 42. After the barrel lock 60 is slid to its new location, an additional length of cord 42 can be pulled through the access opening 54 until the locking component 60 engages the access opening 54. This increases the size of the loops of the cord 42 (or the effective size of the cord 42), as shown in FIG. 4, which enables the pouch 10 to receive a larger item 62' between the cord 42 and the outer surface 20. Conversely, the effective length of the cord 42 can be decreased by sliding the locking component 60 along the cord 42 in the direction opposite to arrow A and locking it in place on the cord 42 at the desired position.

Having described the invention in detail and by reference to the preferred embodiments, it will be apparent that modifications and variations thereof as possible without departing from the scope of the invention.

What is claimed is:

1. A pouch for receiving loose items comprising:

a body having an outer surface and an inner cavity and a width extending across a face of said body;

a cord located on said outer surface for trapping loose items between said cord and said outer surface; and a stiffening element extending substantially about the perimeter of said body to form a substantially closed shape having a central opening fanned therein, wherein said stiffening element has a width that is substantially less than said width of said body, and wherein said pouch lacks any stiffening element or component located in a center portion of said body spaced away from said perimeter, said pouch lacking any stiffening element at said center portion through the entire thickness of said pouch such that said center portion of said body and center portions of both of said panels can be deformed in two opposed directions extending generally perpendicular to a plane defined by said outer perimeter wherein said cord defines a generally rectangular trapping area located between said cord and said outer surface and defined by the outer ends of said cord, and wherein said pouch includes an access opening located on said outer surface for providing access to said inner cavity, and wherein said access opening is generally entirely spaced away from said trapping area.

2. The pouch of claim 1 wherein the effective size of said cord can be adjusted to vary the distance between said cord and said outer surface to receive differently-sized items therebetween.

3. The pouch of claim 1 wherein said cord crisscrosses said outer surface to form a generally "X" shape.

4. The pouch of claim 3 wherein said body is generally rectangular in top view and includes a loop at each corner of said body, said cord being received through each loop.

5. The pouch of claim 4 wherein said body includes a cord opening, and wherein said cord passes through said cord opening, through each of said loops, and back through said cord opening.

6. The pouch of claim 5 further comprising a locking component located on the portions of said cord protruding out from said cord opening, said locking component being shaped to slidably yet lockingly engage said cord, said locking component being slidable along the length of said cord to vary the distance between said cord and said outer surface.

7. The pouch of claim 6 wherein said locking component is a barrel lock.

8. The pouch of claim 1 wherein said cord is elastic.

9. The pouch of claim 1 wherein said body is generally rectangular in top view.

10. The pouch of claim 9 wherein said body include a pair of generally flat pieces of material joined at their outer edges to form said inner cavity therebetween.

11. The pouch of claim 1 wherein said stiffening element is a wire which prevents said body from significantly deforming when an item is placed between said cord and said body.

12. The pouch of claim 1 wherein said body includes a zipper to provide access to said inner cavity.

13. The pouch of claim 1 wherein said stiffening element is received inside a closed casing which extends around said perimeter.

14. The pouch of claim 1 wherein said stiffening element extends only along said outer perimeter.

15. The pouch of claim 1 wherein said body is generally rectangular in front view, and wherein said cord extends to each of said corners of said body such that the trapping area covers substantially all of said body.

16. The pouch of claim 1 wherein said body includes an outer panel and an inner panel defining said inner cavity therebetween, and wherein said cord is located on said outer panel and said stiffening element is coupled to and extends substantially around the perimeter of said outer panel.

17. The pouch of claim 1 further comprising a locking component slidingly coupled to said cord such that said locking component can be slid along said cord to vary the effective length of said cord.

18. The pouch of claim 1 wherein said body includes a pair of opposed panels which are directly joined to form said cavity therebetween and have generally the same size and shape and are at-ranged such that the outer perimeters of said panels are generally aligned.

19. The pouch of claim 1 wherein said body includes a pair of opposed panels that are directly joined together to form said cavity therebetween.

20. The pouch of claim 19 wherein each opposed panel includes an outer perimeter, and wherein said opposed panels are directly joined together along said outer perimeters.

21. A pouch for receiving loose items comprising:

a generally rectangular body having an outer surface, a cord opening, an inner cavity and a width extending across a face of said body, said body including a loop at each corner thereof;

a cord located on said outer surface for trapping loose items between said cord and said outer surface, wherein said cord crisscrosses said outer surface to form a generally "X" shape, said cord extending through said cord opening, through each of said loops, and back through said cord opening; and a stiffening element extending substantially about the perimeter of said body to form a substantially closed shape having a central opening formed therein, wherein said stiffening element has a width that is substantially less than said width of said body.

* * * * *

UNITED STATES PATENT AND TRADEMARK OFFICE

CERTIFICATE OF CORRECTION

PATENT NO. : 6,739,754 B2
DATED : May 25, 2004
INVENTOR(S) : Marc L. Moor et al.

It is certified that error appears in the above-identified patent and that said Letters Patent is hereby corrected as shown below:

Column 3,
Line 35, change the word “fanned” to -- formed --.

Column 4,
Line 41, change the word “at-ranged” to -- arranged --.

Signed and Sealed this

Twenty-seventh Day of July, 2004

JON W. DUDAS
*Acting Director of the United States Patent and Trademark Office*